US006357550B1

(12) United States Patent
Willson

(10) Patent No.: US 6,357,550 B1
(45) Date of Patent: Mar. 19, 2002

(54) ELEVATED ACCOMMODATION ASSEMBLY

(75) Inventor: Ronan Peter Willson, Barnet (GB)

(73) Assignee: Trilogy Entertainments, PLC, Hertfordshire (GB)

( * ) Notice: Subject to any disclaimer, the term of this patent is extended or adjusted under 35 U.S.C. 154(b) by 0 days.

(21) Appl. No.: 09/381,215

(22) PCT Filed: Mar. 19, 1998

(86) PCT No.: PCT/GB98/00836

§ 371 Date: Sep. 16, 1999

§ 102(e) Date: Sep. 16, 1999

(87) PCT Pub. No.: WO98/42935

PCT Pub. Date: Jan. 10, 1998

(30) Foreign Application Priority Data

Mar. 20, 1997 (GB) ..... 9705768

(51) Int. Cl.[7] ..... E04G 1/18
(52) U.S. Cl. ..... 182/141; 52/123.1; 182/131
(58) Field of Search ..... 182/141, 146, 182/131; 52/123.1

(56) References Cited

U.S. PATENT DOCUMENTS

| | | | | | |
|---|---|---|---|---|---|
| 297,335 | A | * | 4/1884 | Adams | 182/141 |
| 3,568,796 | A | * | 3/1971 | Stanhope | 182/141 |
| 4,619,346 | A | * | 10/1986 | Deguerry | 182/141 |
| 5,371,993 | A | * | 12/1994 | Saito | 182/141 |
| 5,417,018 | A | * | 5/1995 | Matsumoto | 52/123.1 |
| 5,870,872 | A | * | 2/1999 | Hinnen | 182/141 |

FOREIGN PATENT DOCUMENTS

| | | | | |
|---|---|---|---|---|
| DE | 3443023 | * | 6/1986 | 182/141 |
| FR | 2219282 | | 2/1973 | 1/35 |
| JP | 403253667 | * | 11/1991 | 182/141 |
| SU | 1099027 | * | 6/1984 | 182/141 |
| WO | WO 88/08903 | | 11/1988 | 1/35 |

* cited by examiner

*Primary Examiner*—Alvin Chin-Shue
(74) *Attorney, Agent, or Firm*—Gary M. Hartman; Domenica N. S. Hartman

(57) ABSTRACT

An accommodation assembly for use as a temporary studio in outside broadcasting comprises a plurality of support legs (2) erectable to upstand from ground level, structural elements (7 to 9) erectable into an accommodation structure (6), and means, such as an electric hoist motor (10) and a chain (11'), arranged to cause the accommodation structure (6), when erected, to self-climb the erected support legs (2) from ground level to an elevation thereabove.

16 Claims, 3 Drawing Sheets

ELEVATED ACCOMMODATION ASSEMBLY

DESCRIPTION

This invention relates to an elevated accommodation assembly and is especially, but not exclusively, related to such an assembly for providing temporary accommodation, such as an outside broadcast studio, in a working environment of limited space.

In service areas associated with, say, sports events, the space available is usually extremely limited, in view of the ever increasing volume of accommodation and equipment required to provide outside broadcast coverage of such events. This is particularly so in motor racing, especially Formula 1, wherein so-called "paddocks", which provide service areas at motor racing venues, have become extremely cramped in view of the increasing public demand for outside broadcast coverage of motor racing events over the past several years.

One method of overcoming this serious lack of space in service areas, such as those discussed above, has been to erect or otherwise provide temporary units, such as studios and other types of allied accommodation and equipment storage space, which may be supported in elevated positions upon scaffolding, one above the other, on a temporary basis. However, that has been found to be unsatisfactory, in that the vehicles assembly and disassembly of the supporting scaffolding is very labour intensive and, thus, expensive. Also, the assembled scaffolding is cumbersome and unsightly.

Accordingly, it is an object of the present invention to provide an elevated accommodation assembly which eliminates, or at least substantially reduces, the disadvantages associated with providing temporary accommodation in, say, a service area of limited space, as discussed above.

Thus, a first aspect of the invention provides an accommodation assembly comprising a plurality of support legs erectable to upstand from ground level, structural elements erectable into an accommodation structure, and means arranged to cause the accommodation structure, when erected, to self-climb the erected support legs from ground level to an elevation thereabove.

With such an inventive assembly, when the support legs are erected to upstand, preferably generally vertically, from ground level, the accommodation structure can be erected from its structural elements, for example, respective floor, wall and/or roof elements, at ground level in conjunction with the erected support legs and then caused to self-climb those legs to a desired elevation above ground level, preferably at the top of the legs.

For an accommodation structure having a floor element of generally rectangular shape, it is preferred to employ four erectable support legs, to provide a vertical support leg at each corner of the accommodation structure. However, any suitable number of support legs may be employed, depending upon the required strength and stability of the accommodation assembly when the accommodation structure is at a desired elevation above ground level.

Throughout this specification, the term "self-climb", or derivative thereof, such as "self-climbing", is used in relation to the ability of the accommodation structure, when erected, to raise itself up the erected support legs without the assistance of any extraneous raising or lifting means additional to the components of the inventive assembly.

The means arranged to cause the erected accommodation structure to self-climb the erected support legs, may be of any suitable form. In the preferred embodiment of accommodation assembly to be described in greater detail hereinbelow, such self-climbing means comprises an electric hoist associated with each support leg, for example at each corner of a generally rectangular accommodation structure, each hoist having an electric motor fixed to the structure and one or more flexible elongate members, such as chains, connected operably to the electric motor and extending up the associated support legs, preferably outside the leg, and over pulleys, preferably two, located at the top of the support leg, to provide a so-called "roller beam". Such chains are preferably double-reaved with respect to the electric motor and the roller beam, such that the load exerted upon the support leg, when being self-climbed by the erected accommodation structure, is distributed substantially evenly on both sides of the leg.

Alternatively, such self-climbing means associated with each erected support leg, may be fixed at the top or base thereof and operably connected to the erected accommodation structure, preferably a structural floor element thereof, by a chain(s) of suitable strength.

Once the accommodation structure has self-climbed the support legs to the desired elevation above ground level, it can then be secured firmly to each support leg preferably at the top thereof.

According to a second aspect of the invention, there is provided a method of erecting an accommodation structure at an elevation above ground level, which method comprises erecting a plurality of support legs upstanding from ground level, erecting an accommodation structure at the bases of the upstanding support legs and causing the so-erected accommodation structure to self-climb the legs to a desired elevation above ground level.

In a preferred inventive method of erecting an elevated accommodation structure in accordance with the invention, a floor element of the accommodation structure is first mounted upon a base leg member of each support leg to which is pivotally attached a main leg member in its lower, generally horizontal position. Then, those main leg members are pivoted upwardly with respect to their base leg members, to provide a corresponding number of generally vertical support legs. A roof element of the accommodation structure is then erected such that it is supported above the floor element by means of wall elements secured therebetween. At this stage, the accommodation structure is substantially fully assembled at the bases of the vertical support legs. Subsequently, the accommodation structure is caused to self-climb the vertical support legs upon which it is mounted, to the desired elevation above ground level, as discussed above in relation to the first aspect of the invention.

In this preferred embodiment, the wall elements of the accommodation structure comprise upstanding elongate structural elements secured between the floor and roof elements which also comprise elongate structural elements. In this condition, the accommodation structure is in the form of a framework which may be suitably clad to provide substantially closed accommodation at the desired elevation above ground. Alternatively, such cladding can be carried out prior to the erected accommodation structure being caused to self-climb the generally vertical support legs.

When the accommodation structure has self-climbed the vertical support legs and is at its desired elevation above ground level, a space may be provided between the underside of the floor element of the accommodation structure and the ground, which may be used for any practical purpose, such as the parking of an associated vehicle, such as an outside broadcast trailer.

Two or more (plurality) accommodation structures may be used, to provide a multi-storey accommodation assembly.

In order that the invention may be more fully understood, a preferred embodiment of accommodation assembly for providing temporary accommodation, such as an outside broadcast studio, and a method of erecting an accommodation structure, will now be described by way of example and with reference to the accompanying drawings in which.

Figure 5A:
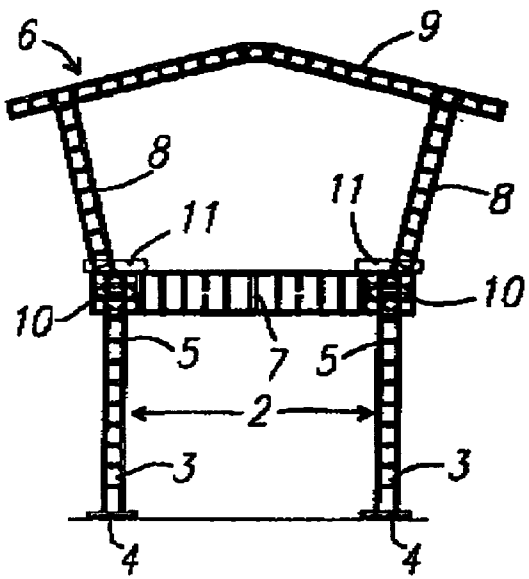

Referring firstly to FIG. 5A of the drawings, an accommodation assembly for use as a temporary studio in outside broadcasting, comprises four (only two shown) vertical support legs 2 each comprising a base leg member 3 with a foot 4 resting on the ground. To each base member 3 is pivotally connected a main leg member 5.

Figure 4:
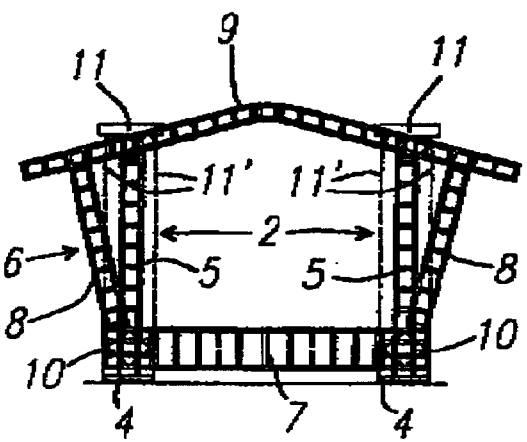
Figure 5B:
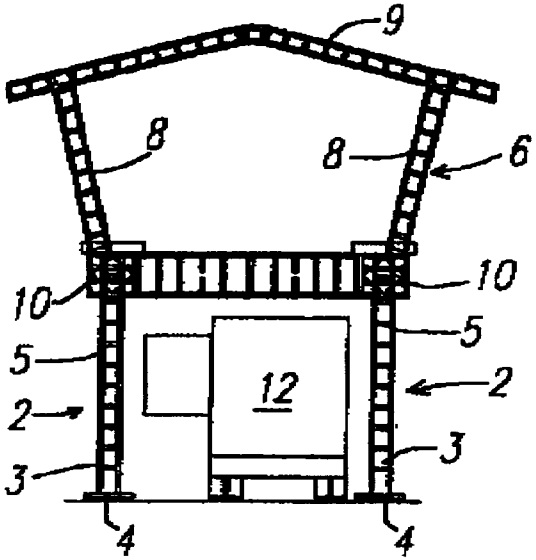

An accommodation structure 6, as shown in FIG. 4 at ground level and in FIGS. 5A and 5B at an elevation above ground level, comprises a generally horizontal floor element 7, a plurality of wall elements 8 whose lower ends are secured to respective sides of the floor element 7 and which are inclined to the vertical, and a roof element 9 which is secured firmly to the upper ends of the wall elements 8.

Figure 7:
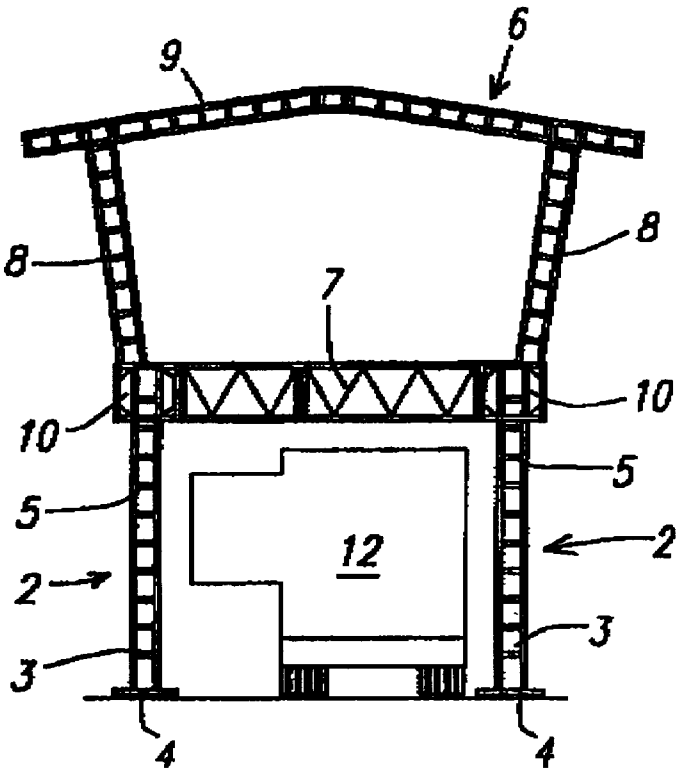
FIGS. 6 and 7 are respective side and end elevational views of the fully-erected accommodation assembly.
Figure 6:
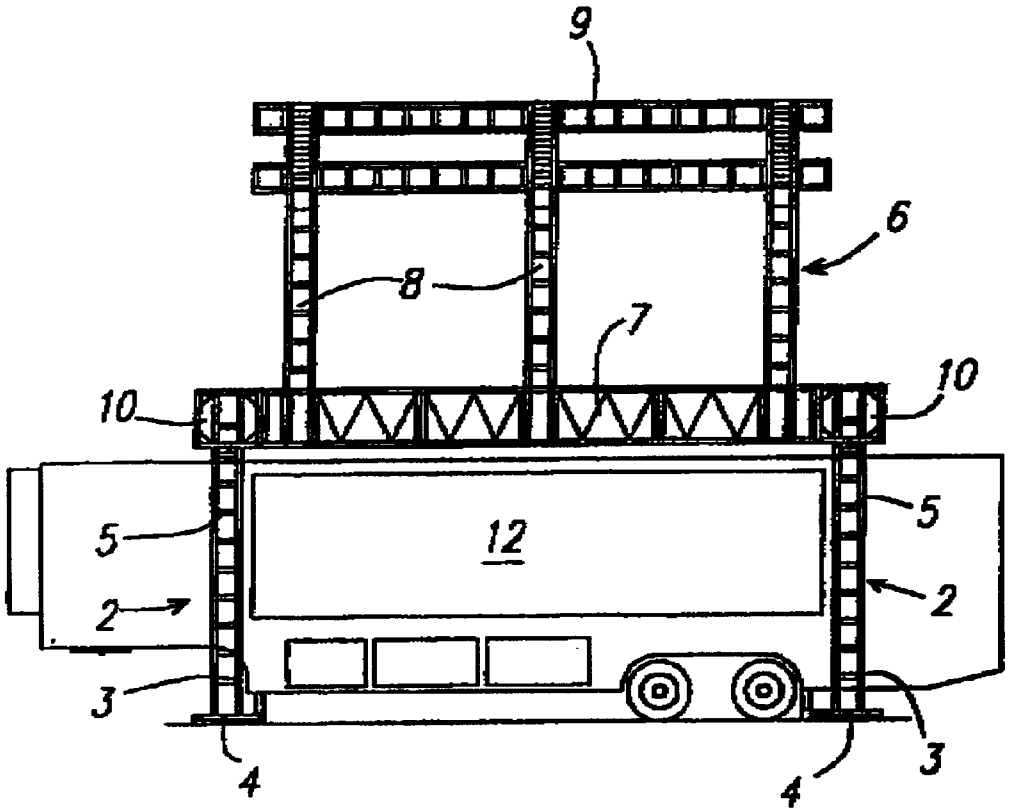
Figure 9:
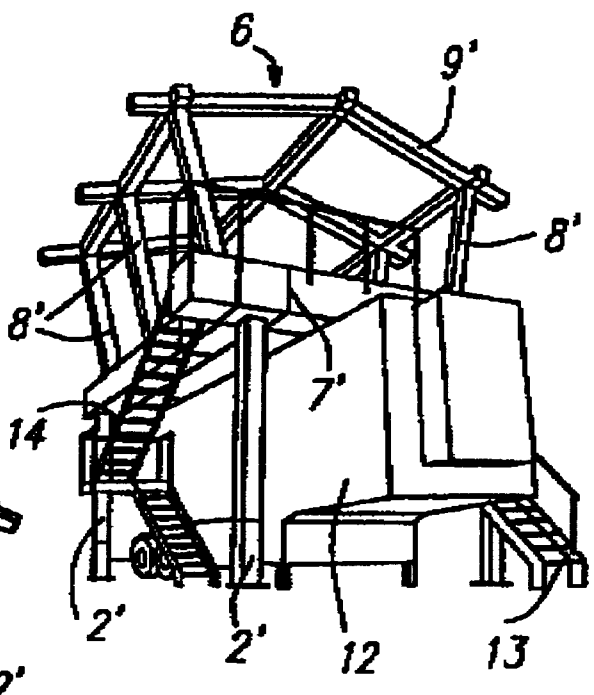
FIGS. 8 to 10 are respective perspective views of the erected accommodation assembly from above and one end, above and the other end, and below and the other end of the assembly, with a trailer parked beneath the accommodation structure of the erected assembly.
Figure 10:
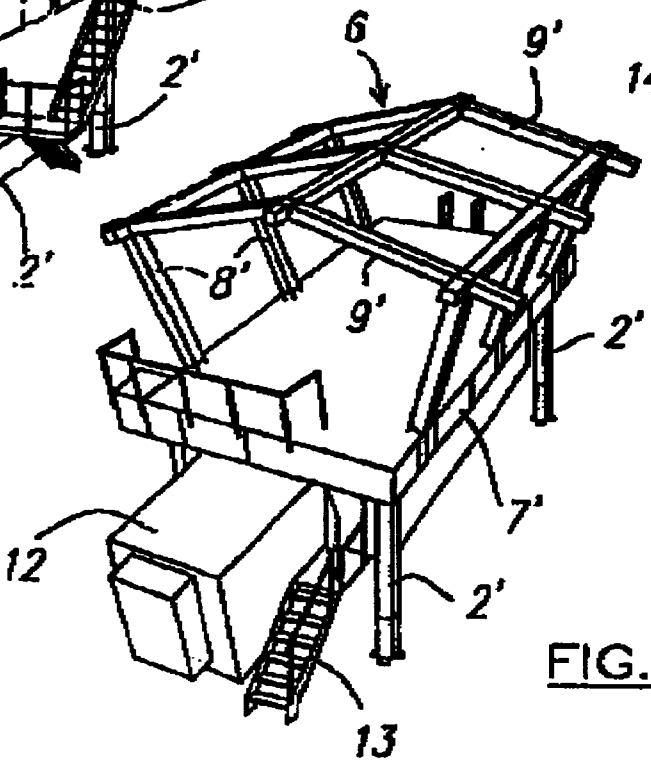
Figure 8:
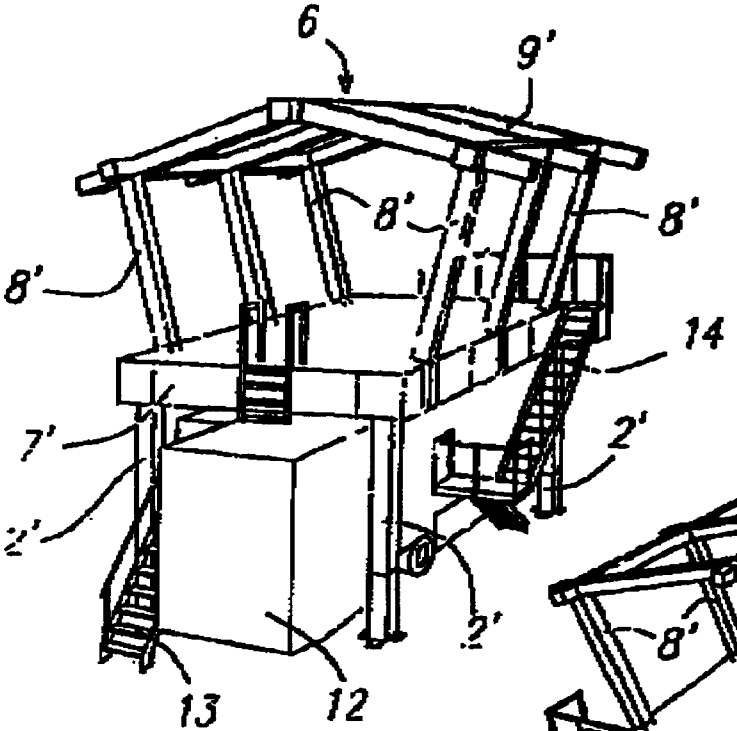

As shown in FIGS. 1 to 4 and FIGS. 5A and 5B, as well as in FIGS. 6 and 7, components of the accommodation assembly, such as, the vertical support legs 2 and the floor, wall and roof elements 7 to 9 of the accommodation structure 6, are of an open framework construction, although in FIGS. 8 to 10, those components have been clad, as indicated at 2' and 7' to 9'.

Further cladding (not shown) is usually provided on the wall and roof elements 8', 9', to provide a substantially closed accommodation structure which may be provided with windows and access doors, where necessary.

Figure 1:
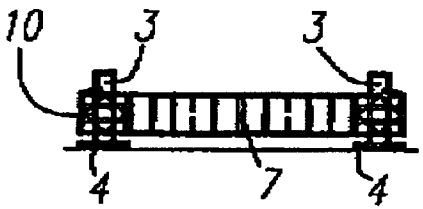
FIGS. 1 to 4 and FIGS. 5A and 5B are respective elevation views of an accommodation assembly during its successive stages of erection.

On erection of the accommodation assembly, as shown in FIGS. 1 to 4 and FIG. 5A, the four base leg members 3 are located at ground level with their feet 4 on the ground, and the floor element 7 of the accommodation structure 6 is mounted upon those base leg members 3 at each corner thereof, as shown in FIG. 1. Main leg members 5, which are pivotally connected at their lower ends to respective base leg members 3, are in an initial, generally horizontal position and, as such, cannot be seen in FIG. 1.

Figure 2:
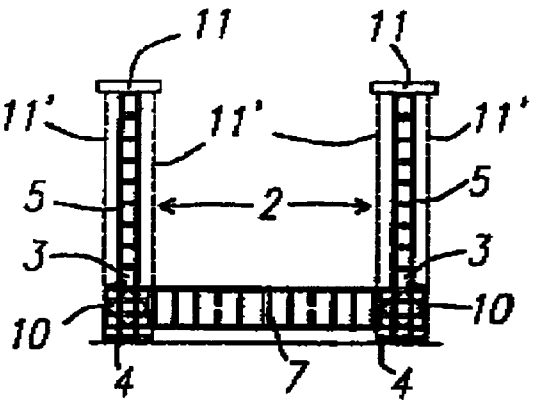
Figure 3:
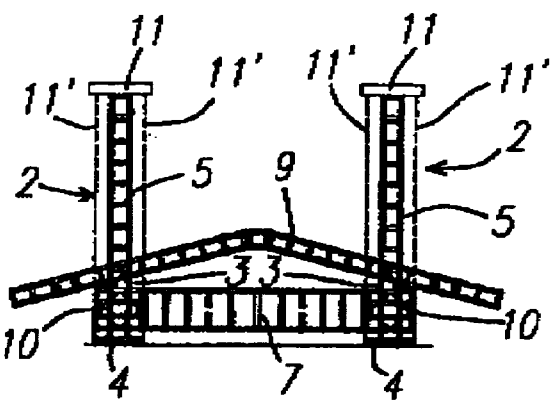

Then, the four main leg members 5 are pivoted with respect to the base leg members 3 into their vertical positions, as shown in FIG. 2, to form the four erected support legs 2. The roof element 9 is then mounted upon the support legs 2, as shown in FIG. 3, and raised into the position shown in FIG. 4.

The roof element 9 is then supported above the floor element 7 by the six spaced wall elements 8 which are inclined outwardly and to the vertical.

At this stage of erection, the accommodation structure 6, as shown in FIG. 4, is now ready to self-climb the support legs 2.

At each corner of the floor element 7 is provided an electric hoist motor 10 mounted securely thereto. Each electric hoist motor 10 is provided with a chain 11' which extends upwardly on either side and exterior of the associated support leg 2 and over a roller beam 11 which is located at the top of the support leg 2 and comprises two pulleys (not shown) arranged such that the load exerted upon the support leg 2 when being self-climbed by the erected accommodation structure 6, is distributed substantially evenly on both sides of the leg 2, to maintain the stability thereof.

Thus, each electric hoist motor 10 is connected operably with its associated support leg 2 via the chain 11', which may be double-reaved, to provide the self-climbing ability of the erected accommodation structure 6.

In this manner, the accommodation structure 6 when erected at ground level, as shown in FIG. 4, can self-climb the four support legs 2 to an elevation above ground level, as shown in FIGS. 5A and 5B.

Once at that elevation, the accommodation structure 6 can be secured firmly to the top end of each support leg 2.

In FIG. 5B, an outside broadcast trailer 12 is shown parked in the space provided between the underside of the floor element 7 of the now-elevated accommodation structure 6 and ground level.

Similarly, FIGS. 6 and 7 show side and end views of the elevated accommodation structure 6 with the trailer 12 parked thereunder.

The clad floor, wall and roof elements 7' to 9', as well as the clad support legs 2', are shown in FIGS. 8 to 10. Additional cladding (not shown) can be used to provide a substantially closed, elevated accommodation structure 6, with doors and windows where necessary.

FIGS. 8 to 10 also show stairways 13, 14 for providing access to the parked trailer 12 and the elevated accommodation structure 6, respectively.

Thus, it can be seen that the invention provides temporary accommodation which is suitable for use in limited spaces, such as the paddocks or other service areas at, say, motor racing venues, thereby increasing, and usually doubling, the amount of available working space.

Although the embodiment of accommodation assembly described above has one accommodation structure 6, it is to be appreciated that two or more such structures 6 can be provided, whereby each can self-climb the support legs 2, in turn, to a required elevation above ground level, thus providing a multi-storey accommodation assembly. With such a multi-storey arrangement, it is preferred that only the uppermost accommodation structure 6 has a roof element 9, in which case, the floor element 7 of an upper accommodation structure 6 may serve also as a flat roof element of the lower structure 6 immediately below.

What is claimed is:

1. A temporary accommodation assembly configured to be assembled to form an erected accommodation structure that is cable of being raised to form an elevated accommodation structure and then subsequently lowered and disassembled for relocation of the assembly, the assembly comprising:

a plurality of support legs pivotally attached to bases respective so as to be erectable to upstand on the bases respective directly from ground level and thereby define a space bounded by the support legs, a ground-level area bounded by the bases, and wherein each of said bases are separate form each other to define openings between adjacent pairs of support legs and their respective bases by which ground-level access exists to the space and the ground-level area, structural elements comprising a floor, wall and roof that are assembled and forming the erected accommodation structure within the space and over the ground-level area, and self-climbing means interconnected between the support legs and the erected accommodation structure causing the erected accommodation structure to self-climb the support legs by movement of the erected accommodation structure relative to the support legs from ground level through the space to an elevation thereabove to yield the elevated accommodation structure, wherein the elevated accommodation structure is configured to be supported by the support legs to define within the space an accessible space at ground level beneath the elevated accommodation structure that includes the ground-level area between the support legs so that the accessible space is accessible at ground level through the openings between the support legs.

2. An assembly according to claim 1, wherein the structural elements define a rectangular shape with four corners, in plan, and wherein each of the bases is located at a corresponding one of the four corners.

3. An assembly according to claim 1, wherein the self-climbing means comprises an electric hoist associated with each support leg.

4. An assembly according to claim 3, wherein each of the electric hoists comprises an electric motor mounted to the structural elements.

5. An assembly according to claim 4, wherein each of the self-climbing means further comprises a pulley and an elongate flexible member, each of the pulleys being mounted to an end of a corresponding one of the support legs, each of the elongate flexible members being connected at a first end thereof to a corresponding one of the electric motors, extending over a corresponding one of the pulleys, and being secured at an oppositely-disposed second end thereof to the floor of the structural elements.

6. An assembly according to claim 5, wherein each of the elongate flexible members further extends over a second pulley mounted to at the end of the corresponding one of the support legs, wherein the pulleys define a roller beam.

7. An assembly according to claim 6, wherein each of the elongate flexible members is double-reaved with respect to the corresponding one of the electric motors and the corresponding one of the roller beams, such that a load exerted upon the corresponding support leg, when being self-climbed by the erected accommodation structure, is distributed substantially evenly on opposite sides of the support leg.

8. An assembly according to claim 5, wherein each of the elongate flexible members extends along a side of the corresponding one of the support legs.

9. An assembly according to claim 1, further comprising means for securing the erected accommodation structure to each of the support legs at an elevation above ground level.

10. A method of providing a temporary accommodation at an elevation above ground level, the method comprising the steps of:

locating at ground level a plurality of support legs comprising main leg members and base leg members, each main leg member pivotally attached to a respective base leg member; pivoting the main leg members relative to their respective base leg members;

erecting the support legs to upstand directly from ground level and define a ground-level area and a space thereabove that are bounded by the support legs, and wherein each of said base leg members are separate form each other to define openings between adjacent pairs of support legs by which ground-level access exists to the space and the ground-level area;

erecting an accommodation structure comprising a floor, wall and roof between bases of the erected support legs so that the accommodation structure is within the space and extends over substantially the entire ground-level area between the support legs;

causing the erected accommodation structure to self-climb the erected support legs by moving relative to the erected support legs from the ground-level area through the space to an elevation directly above the ground-level area, thereby yielding an elevated accommodation structure that is supported by the erected support legs to define an accessible space beneath the elevated accommodation structure that includes the ground-level area between the erected support legs so that the accessible space is accessible at ground level through openings between the support legs;

placing and then removing articles in the accessible space through the openings between the support lets; and then subsequently lowering the elevated accommodation structure, disassembling the erected accommodation structure, and then moving the disassembled accommodation structure and the support legs to a different locale.

11. A method according to claim 10, wherein:

the step of erecting the accommodation structure comprises mounting a floor element upon a base leg member of each of the erected support legs to each of which is pivotally attached a main leg member in a lower, horizontal position; and the step of erecting the plurality of support legs comprises pivoting the main leg members upwardly with respect to their respective base leg members; and the step of erecting the accommodation structure further comprises mounting and supporting a roof element above the floor element by means of wall elements secured therebetween;

after which the step is performed of causing the erected accommodation structure to self-climb the erected support legs to an elevation above ground level.

12. A method according to claim 11, further comprising the step of cladding at least one of the floor, wall and roof elements to substantially enclose the erected accommodation structure.

13. A method according to claim 12, wherein the step of cladding the at least one floor, wall and roof element is performed prior to or after the step of causing the erected accommodation structure to self-climb the erected support legs.

14. A method according to claim 10, further comprising the step of cladding the erected support legs.

15. A method according to claim 10, wherein the article is a vehicle that is parked and then removed from the accessible space through one of the openings between the support legs.

16. A method of providing a temporary accommodation at an elevation above ground level so as to define an accessible space at ground level beneath the temporary accommodation, the method comprising the steps of:

locating at ground level a plurality of bases, support legs pivotally attached to the bases, and a floor element mounted to each of the bases;

pivoting the support legs relative to their respective bases to cause the support legs to upstand on the bases directly from ground level and thereby define a space bounded by the support legs, a ground-level area bounded by the bases, and wherein each of said bases are separate form each other to define openings between adjacent pairs of support legs and their respective bases by which ground-level access exists to the space and the ground-level area;

erecting on the floor element and within the space walls and a roof forming an accommodation structure with the floor element, so that the accommodation structure extends over substantially the entire ground-level area;

causing the accommodation structure to self-climb the upstanding support legs by moving relative to the erected support legs from the ground-level area, through the space, to an elevation directly above the ground-level area so that the accessible space is defined at ground level beneath the accommodation structure, the accessible space comprising the entire ground-level area between the upstanding support legs so that the accessible space is accessible at ground level through the openings between the support legs;

placing and then removing a vehicle in the accessible space through one of the openings between the support legs; and then lowering the accommodation structure, disassembling the accommodation structure, lowering the support legs, and then moving the disassembled accommodation structure to a different locale.

* * * * *